United States Patent [19]

Wisell

[11] 4,276,085

[45] Jun. 30, 1981

[54] HIGH SPEED STEEL

[75] Inventor: Henry L. Wisell, Söderfors, Sweden

[73] Assignee: Uddeholms Aktiebolag, Hagfors, Sweden

[21] Appl. No.: 111,963

[22] Filed: Jan. 14, 1980

Related U.S. Application Data

[63] Continuation of Ser. No. 951,399, Oct. 16, 1978, which is a continuation of Ser. No. 851,765, Nov. 15, 1977, abandoned.

[30] Foreign Application Priority Data

Nov. 22, 1976 [SE] Sweden ..... 7610346

[51] Int. Cl.[3] ..... C22C 39/14

[52] U.S. Cl. ..... 75/126 C; 75/126 E; 75/126 H

[58] Field of Search ..... 75/126 C, 126 H, 126 E, 75/122, 134 F, 176

[56] References Cited

U.S. PATENT DOCUMENTS

| | | | |
|---|---|---|---|
| 1,998,953 | 4/1935 | Emmons | 75/1 |
| 1,998,956 | 4/1935 | Emmons | 75/1 |
| 1,998,957 | 4/1935 | Emmons | 75/1 |
| 2,147,122 | 2/1939 | Emmons | 75/128 |
| 3,012,879 | 12/1961 | Schempp et al. | 75/126 |
| 3,850,621 | 11/1974 | Haberling et al. | 75/126 A |

*Primary Examiner*—L. Dewayne Rutledge
*Assistant Examiner*—Upendra Roy
*Attorney, Agent, or Firm*—Burns, Doane, Swecker & Mathis

[57] ABSTRACT

There is disclosed a tool steel having a very high wear resistance for cutting purposes which consists essentially of 0.8–1.2 wt. % C, 3.0–6.0 wt. % Cr, up to 40 wt. % W, up to 20 wt. % Mo where W+2Mo=20.0–40 wt. %, up to 15 wt. % Co, not more than about 0.1 wt. % V, balance Fe and normal impurities.

5 Claims, 1 Drawing Figure

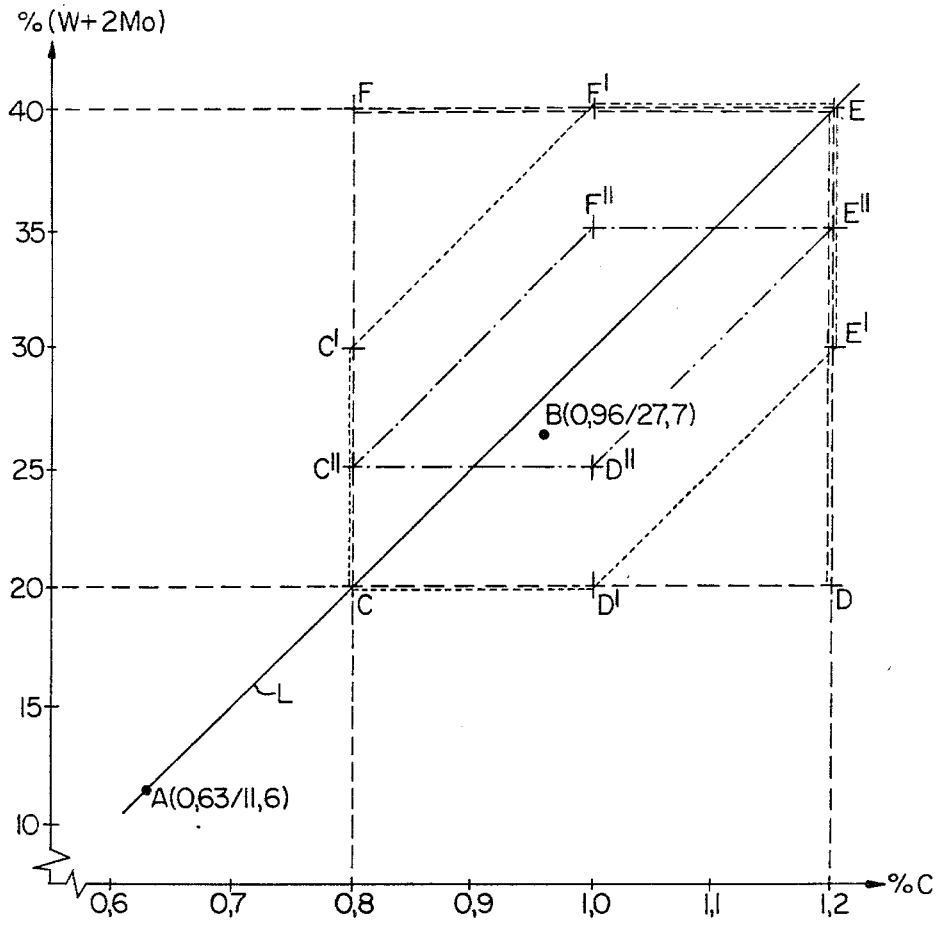
% (W+2Mo)
40
35
30
25
20
15
10
F
F'
E
F''
E''
C'
E'
B(0,96/27,7)
C''
D''
C
D'
D
L
A(0,63/11,6)
0,6
0,7
0,8
0,9
1,0
1,1
1,2
%C

HIGH SPEED STEEL

This is a continuation of pending application Serial No. 951,399, filed on Oct. 16, 1978, which in turn is a continuation application of Serial No. 851,765, filed Nov. 15, 1977, now abandoned.

The present invention relates to metal alloys in the first place intended to be used for metal cutting tools such as milling cutters, boring, turning and planing tools, broaches and the like, where high demands are raised upon hardness and wear resistance.

At about the turn of the century there was introduced a new group of alloys referred to as high speed steels intended for tools, in the first place for metal cutting tools. Originally, these new alloys consisted of a carbon steel which had been alloyed with about 4% Cr and 18% W (in this specification % shall be referred to as weight percent not otherwise indicated). The content of Cr has been maintained at about this value, while the content of W successively has been partially replaced by Mo. The rule has been that two weight parts of W has been replaced by one weight of Mo. The reason for this is that the atomic weight for Mo is about twice the atomic weight for W and as the formed carbide has the formular $M_6C$, where M may be Mo or W, there will be consumed twice as much W as Mo in terms of weight to form the carbide $M_6C$. A further development of these steels is characterized in that V has been added to the alloy at the same time as the carbon content has been increased. This has given rise to another type of carbide, generally known as MC, has been introduced into the steel alloy in addition to $M_6C$ (M in the MC carbide predominantly consists of V while M in the $M_6C$ carbide predominantly consists of Mo and W). It is the opinion that this has improved the wear resistance as MC is a harder carbide than $M_6C$. Moreover in many high speed steels it has been possible to increase the total amount of carbides which also has improved the wear resistance.

We have now surprisingly found that it is possible further to increase the total amount of carbide and hence the wear resistance by following a new line of development. The desired result can be achieved by excluding V in the steel at the same time as the amount of W and/or Mo is increased so that the total amount of $W+2\times Mo$ will be more than 20% and the C-content is correspondingly increased.

The invention therefore refers to alloys which as a characteristic feature have an increased wear resistance as compared to previous conventional high speed steels and which contains the following components 0,8—1,2 wt-% C
3—6 wt-% Cr
0—20 wt-% Mo where $W+2\times Mo=20$–40 wt-%
0—40 wt-% W
0—15 wt-% Co
max 0,5 wt-% V Balance essentially iron and normal impurities.

Preferably the V-content is less than about 0.1%. Such carbide forming metals as Ti, Nb, Ta, Zr and Al should preferably not be present in the steel but can be tolerated as impurities up to a total amount of 0.5%. The content of Mn is normally not more than 0.5% but can be increased up to about a maximum of 1.0%, preferably when sulphur is present in significant quantities up to a maximum of 0.2%. When Mn is present in normal quantities up to a maximum of 0.5%, sulphur, however, preferably is present only to an amount referred to as an impurity.

In the drawing is shown a diagram where wt-% C has been set out along the abscissa axis and wt-% (W+2 Mo) has been set out along the ordinate axis. From the diagram there can be read out the suitable carbon content for various contents of W+2 Mo. The broadest chemical composition limits of the steel of this invention are defined by the above given table. A more limited range is defined by the area in the diagram as defined by the coordinates for the points C-D-E-F-C, where

| | |
|---|---|
| point C has the coordinates | 0.8/20 |
| point D has the coordinates | 1.2/20 |
| point E has the coordinates | 1.2/40 |
| point F has the coordinates | 0.8/40 |

Preferably the amounts of carbon and (W+2 Mo) are chosen such that they fall within the area C-D'-E'-E-F'-C'-C where

| | |
|---|---|
| point C' has the coordinates | 0.8/30 |
| point D' has the coordinates | 1.0/20 |
| point E' has the coordinates | 1.2/30 |
| point F' has the coordinates | 1.0/40 |

The desired balance of carbon and (W+2 Mo) may be provided in the area C''-D''-E''-F''-C'', where

| | |
|---|---|
| point C'' has the coordinates | 0.8/25 |
| point D'' has the coordinates | 1.0/25 |
| point E'' has the coordinates | 1.2/35 |
| point F'' has the coordinates | 1.0/35 |

A preferred composition contains max about 35 wt-% W, max 17.5 wt-% Mo, W+2 Mo totally being max 35 wt-%, at the same time as the carbon content most suitably will be in the range 0.8–1.1%.

In order to verify the invention a great number of experiment alloys have been made. These alloys have been produced according to ASEASTORA-process, which is disclosed i.e. in "Iron & Steel Special Issue", page 49–52 and in "Jernkontorets Annaler 156 (1972)", page 84–90.

In Table 1 the analysis is given for the most adequate experimental alloys (the seven first alloys) and some more convential grades (the last four alloys). All these alloys have been tested by an intermittent laboratory working test, the so called SFA-test. (As far as the SFA-test is concerned, see Proceeding 3rd MTDR Conference, Birmingham Sept. 1962, Pergamon Press, London 1963, pages 55–67. Standardized Milling Test by Gösta Niklasson. Metal Cutting Research Department, Svenska Flygmotor AB Trollhättan, Sweden). The working material was grade SIS 2541-03, 300 HB. The test was carried out without cooling, with the cutting speed 42,95 m/min, and with the worn out criterion 0,7 mm flank wear (Verschleissmarkenbreite). The results are disclosed in Table 2 in which:

The first column refers to the alloys according to Table 1;

The second column refers to the hardening temperature in °C.;

The third column refers to the tempering temperature in °C.

Tempering was made three times and the holding time at the given temperature each time was 1 hour;

the fourth column refers to the surface hardening according to Rockwell C; and the fifth column discloses the life time in minutes.

It is evident that alloy L2 has a superior life time as compared to the other steel grades which all contain V.

TABLE 1

| Alloy | C | Si | Mn | Cr | Mo | W | Co | V |
|---|---|---|---|---|---|---|---|---|
| | Weight - % | | | | | | | |
| A 7 | 2,55 | 0,58 | 0,25 | 4,0 | 5,3 | 6,5 | 8,0 | 7,5 |
| F 13 | 1,99 | 0,50 | 0,29 | 3,7 | 7,8 | 10,1 | 8,0 | 5,0 |
| H 10 | 2,18 | 0,50 | 0,30 | 4,5 | 4,3 | — | 8,0 | 5,9 |
| L 2 | 0,96 | 0,42 | 0,38 | 3,8 | 8,5 | 10,7 | 7,8 | <0,1 |
| L 6 | 1,20 | 0,52 | 0,36 | 4,1 | 8,0 | 10,0 | 8,5 | 1,8 |
| L 11 | 1,72 | 0,53 | 0,36 | 4,1 | 8,4 | 11,0 | 8,1 | 4,3 |
| K 3 | 1,15 | 0,31 | 0,40 | 4,0 | 10,4 | 14,0 | 7,9 | <0,1 |
| ASP 30 | 1,27 | 0,48 | 0,27 | 4,1 | 5,1 | 6,2 | 8,4 | 3,0 |
| ASP 60 | 2,28 | 0,56 | 0,36 | 4,1 | 7,2 | 6,0 | 10,1 | 6,7 |
| M 2 | 0,87 | 0,24 | 0,29 | 4,1 | 4,9 | 6,6 | 0,23 | 1,93 |
| M 35 | 0,91 | 0,27 | 0,33 | 4,1 | 4,8 | 6,1 | 5,1 | 1,85 |

TABLE 2

| Alloy | Hardening temp. °C. | Tempering temp. °C. | Surface hardness, RC | Life time minutes |
|---|---|---|---|---|
| A 7 | 1160 | 560 | 66,5 | 37,2 |
| F 13 | 1180 | 560 | 68 | 37,0 |
| H 10 | 1150 | 560 | 66 | 31,6 |
| L 2 | 1200 | 560 | 66,5 | 60,8 |
| L 6 | 1190 | 560 | 68 | 49,4 |
| L 11 | 1180 | 560 | 66,5 | 42,2 |
| ASP 30 | 1180 | 560 | 66 | 43,1 |
| ASP 60 | 1180 | 560 | 67,5 | 32,4 |
| M 2 | 1220 | 560 | 65 | 25,4 |
| M 35 | 1230 | 560 | 67 | 32,5 |

At a second test series cooling was carried out. The working material as in the previous test series was grade SIS 2541-03, 300 HB. The worn out criterion was 0,3 mm flank wear, and the tests were carried out with the cutting speeds 35,81 m/min, 42,95 m/min and 50,11 m/min. The results are disclosed in Table 3.

TABLE 3

| Alloy | Life time at the cutting speed: 35,81 m/min | 42,95 m/min | 50,11 m/min |
|---|---|---|---|
| L 2 | 73,7 | 64,4 | 42,2 |
| L 6 | 51,9 | 44,9 | 27,4 |
| K 3 | 70,5 | 64,0 | 24,6 |
| ASP 30 | 41,9 | 27,3 | 18,8 |
| ASP 60 | 29,9 | 22,8 | 19,4 |
| M 35 | 40,2 | 24,4 | 25,7 |
| M 2 | 36,7 | 28,7 | 21,1 |

This test shows the same condition as at the previous test, namely that those steel alloys (L2 and K3) which do not contain significant amounts of V and hence not any MC-carbide brings about the best results.

Alloy K3 contains greater amount of carbides than alloy L2 as is apparent from the analysis in Table 1. At the highest cutting speed in Table 3, 50,11 m/min, where the impact stress is at its maximum, alloy K3 has not proven to be as good as alloy L2. This was due to the fact that splinters (flakes) were torn off from the edge. This condition is due to an unsufficient toughness of the material, which in turn is due to the large amount of carbides. Alloy K3 therefore is considered to be near the maximally conceivable amount of carbides that may be used for practical purposes.

The carried out tests clearly show that the performance of the high speed steel may be considerably improved by increasing the amount of $M_6C$-carbides at the same time as MC-carbides are excluded in the steel alloy. The mode of obtaining this result is to increase the amount of the $M_6C$-carbide forming elements Mo and W and to eliminate the element V in the chemical composition of the steel.

By alternating the carbon content but keeping the steel composition constant in other respects, and by means of the SFA-test, that carbon content has been determined which brings about the longest life time. In this way the carbon content in alloy L2 as in the 6 other type alloys have been determined. By analysing the matrix of alloy L2 the following results have been obtained as expressed in weight-%:

C=0,63%
Si=0,26%
Mn=0,45%
Cr=4,0%
Mo=4,3%
W=3,0%
Co=9,0%
Fe=78,3%

The straight line L in the diagram has been constructed in the following way: The carbon content in weight-% has been set out along the x-axis and the total amount of W plus the double amount of Mo along the y-axis. Point A represents the condition existing in the matrix of the steel alloy L2, while point B represents the chemical composition of the entire of steel alloy L2. Under the presumption that there is a constant ratio between C, Mo and W in matrix the carbon content can be represented by a straight line through points A and B. According to the invention the total amount of W+ the double amount of Mo shall be between 20 and 40%. By utilizing the above mentioned straight line L it is possible to state that the carbon content approx. should lie between the limits 0,8 and 1,2% bringing about a sufficient quantity of carbon to supply as well the matrix of the steel as the $M_6C$ carbides.

According to the invention therefore a high speed steel with very good properties shall have the composition which is apparent from the accompanying claims.

I claim:

1. Tool steel having a very high wear resistance for cutting purposes characterized in that it consists essentially of:

C 0.8–1.2 wt%
Cr 3.0–6.0 wt%
W up to 40 wt%
Mo up to 20 wt% where W+2Mo=20.0–40 wt%
Co up to 15 wt%
V not more than about 0.1 wt%
Balance Fe and normal impurities.

2. Tool steel according to claim 1, characterized in that the content of W is max about 35 wt-%, the content of Mo max about 17.5 wt-%, the total amount of W+2Mo being max about 35 wt-%, and that the content of C lies within the range of 0.8–1.1 wt-%.

3. Tool steel according to claim 1, characterized in that the amounts of C and W+2Mo lies within the area C-D-E-F-C in the accompanying diagram.

4. Tool steel according to claim 1, characterized in that the amounts of C and W+2Mo lies within the area C-D'-E'-E-F'-C'-C in the accompanying diagram.

5. Tool steel according to claim 1, characterized in that the amounts of C and W+2Mo lie within the area C''-D''-E''-F''-C'' in the accompanying diagrams.

* * * * *